US006575380B2

(12) United States Patent
Corbett

(10) Patent No.: US 6,575,380 B2
(45) Date of Patent: Jun. 10, 2003

(54) SPRINKLER SPACER AND GUIDE SYSTEM

(76) Inventor: J. Craig Corbett, P.O. Box 957, 113 S. Grant #18, Lyman, WY (US) 82937

( * ) Notice: Subject to any disclaimer, the term of this patent is extended or adjusted under 35 U.S.C. 154(b) by 29 days.

(21) Appl. No.: 10/007,712

(22) Filed: Nov. 13, 2001

(65) Prior Publication Data

US 2003/0089790 A1 May 15, 2003

(51) Int. Cl.[7] ..... B05B 17/00; B05B 1/28

(52) U.S. Cl. ..... 239/1; 239/200; 239/201; 239/288; 239/273

(58) Field of Search ..... 239/200–206, 239/1, 273, 276, 282, 288, 288.3, 288.5, DIG. 1; 248/75, 80, 87

(56) References Cited

U.S. PATENT DOCUMENTS 2,080,341 A * 5/1937 Schumacher ..... 239/201
3,015,448 A * 1/1962 Hurless ..... 239/288.5
3,265,310 A * 8/1966 Cohen ..... 239/201
3,650,478 A * 3/1972 Jones ..... 239/201
3,904,120 A * 9/1975 Sbicca ..... 239/201
5,211,338 A * 5/1993 Leite et al. ..... 239/288.5

* cited by examiner

*Primary Examiner*—Steven J. Ganey
(74) *Attorney, Agent, or Firm*—Dean P. Edmundson

(57) ABSTRACT

A system for providing a predetermined minimum spacing between a sprinkler head and a sidewalk, curb or the like when installing a sprinkler head in a lawn or other landscaped area. The system includes a spacer or guide which can be attached to the sprinkler head at the time of installation. The spacer includes an inner portion and an outer portion which is intended to be positioned adjacent to (or in close proximity to) the edge of a sidewalk or curb. The width of the spacer determines a minimum distance of spacing between the sprinkler head and the sidewalk or curb. The spacer may include a vertical tab to assure that the spacer is sufficiently far below the ground surface that it will not be contacted by a lawn edging tool. Use of the spacer assures that there will be sufficient spacing between the sprinkler head and the sidewalk, etc. for a lawn edging tool to be used there without damaging the sprinkler head.

17 Claims, 9 Drawing Sheets

FIG. 11
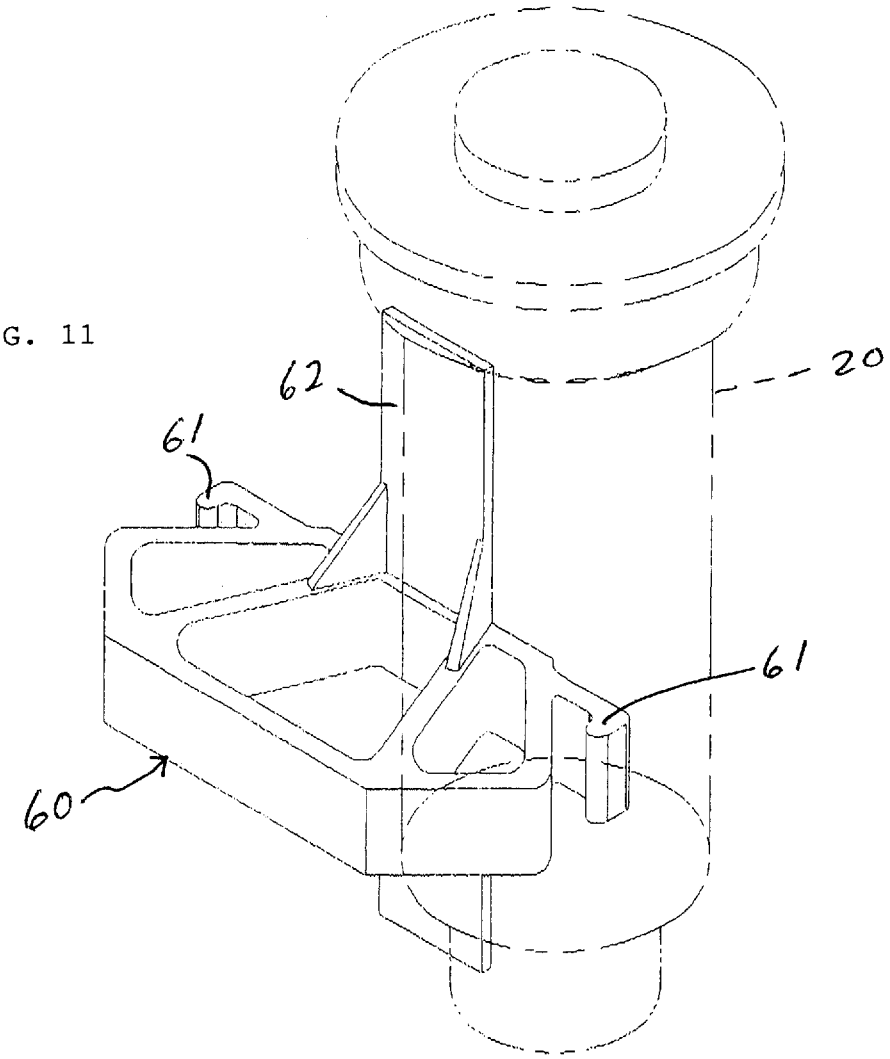
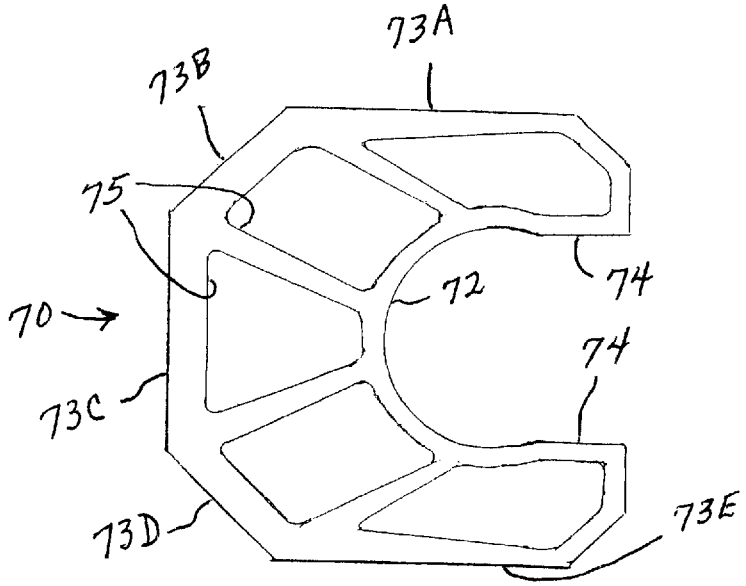
FIG. 12

SPRINKLER SPACER AND GUIDE SYSTEM

FIELD OF THE INVENTION

This invention relates to sprinkler systems of the type commonly used for sprinkling lawns. More particularly, this invention relates to installation techniques for sprinkler systems. Even more particularly, this invention relates to means for installing sprinkler heads next to sidewalks, curbs, etc.

BACKGROUND OF THE INVENTION

Sprinkler systems are in very common usage for lawns and other landscaped areas. A typical system includes water supply lines which are placed below ground and extend from a main supply pipe to each sprinkler head which extends upwardly from the supply line to the upper surface of the ground. Typical sprinkler heads are of the "pop-up" style which extend upwardly above the grass when pressure is applied to the water in the supply line, and then the sprinkler head retracts when it is no longer in use. The top of the sprinkler head remains exposed at ground level.

A serious problem often arises when a sprinkler head is installed too close to a sidewalk, curb or other solid or rigid object. Normally, during conventional edging techniques (i.e. where an edger with a metal blade must be used to cut away a narrow strip of grass along the edge of the sidewalk), the spinning metal blade of the edger can irreparably damage any sprinkler head which has been installed too close to the sidewalk, curb, etc. In such situations, the damaged sprinkler head must be replaced. This involves considerable time and expense. In order for the spinning metal blade of the edge to pass safely between the sidewalk or curb and the sprinkler head, there is preferably a space of about 1 to 2 inches between the sidewalk, curb, etc. and the perimeter of the sprinkler head. If the sprinkler head is too close to the sidewalk, curb, etc., the person operating the lawn edger must lift the edger out of the ground whenever he encounters such a sprinkler head and then carefully reinsert the edger into the ground on the other side of the sprinkler head. This requires familiarity, patience and alertness on the part of the person operating the edger.

U.S. Pat. No. 5,102,048 (Bohnhoff) describes an irrigation head support which is a circular mat with a plurality of concentric circular ribs connected by a plurality of radially extending ribs. There is an opening in the center of the mat for receiving an irrigation head. The mat also includes a plurality of upwardly extending rings which are spaced around the outer portion of the mat. The upper surface of such rings is to be placed at ground level when the mat and the irrigation head are installed (e.g. on a golf course). The purpose of the guard is said to be for protecting an irrigation head from vehicle tires and for preventing erosion of the soil surrounding the head. The circular mat was not designed or intended for use in connection with obtaining the proper spacing of sprinkler heads in lawns from sidewalks, curbs, etc. where edgers are used.

U.S. Pat. No. 5,678,353 (Tsao et al.) describes a grass guard for preventing growth of any vegetation around a perimeter of an object (e.g. a sprinkler head). The grass guard is composed of two layers. The top layer is a plastic sheet simulating grass, and the bottom layer is made of heavy grit bonded into a uniform body with a polymer. The grass guard is shown as a circular mat which has a central opening for a sprinkler head to fit through. The grass guard is intended for use around existing sprinkler heads. Where a sprinkler head is already located adjacent to a sidewalk, for example, one side of the grass guard can be cut away. There is no description in the patent regarding use of the grass guard during installation of a sprinkler head to maintain proper position of the sprinkler head, and even if the grass guard was used, a lawn edger would still hit it while edging.

U.S. Pat. No. 6,186,416 (Jones) describes a trim ring for use around a lawn sprinkler to discourage grass growth around it and to protect the sprinkler by indicating its location. The trim ring includes two complementary plates, each having a notch which, when assembled, forms a central aperture fitting around a sprinkler body. The overlapped plates are then secured to each other by screws.

The patent does not describe use of the trim ring for positioning sprinkler heads during installation next to a sidewalk or curb, etc.

U.S. Pat. No. 4,146,181 (Soos) describes a guard ring for a lawn sprinkler. The guard ring includes a central sleeve for surrounding the upper portion of the sprinkler head, and a frustoconical skirt extends outwardly and downwardly from the upper edge of the sleeve. A plurality of stabilizing fins extends downwardly and outwardly from the periphery of the skirt. The guard ring is for protecting the sprinkler head from lawn mowers which drive over the sprinklers. The patent does not describe use of the guard ring for positioning of sprinkler heads adjacent to sidewalks, curbs, etc.

U.S. Design Patent D410,731 (Bowman et al.) shows a sprinkler head guard which appears to be a circular disk with an off-set opening extending through it. The apparent purpose of the guard is to protect the sprinkler head from the activity of conventional lawn mowers.

There has not heretofore been provided a simple and effective means to assure proper positioning of sprinkler heads during installation adjacent to sidewalks, curbs, etc.

SUMMARY OF THE INVENTION

In accordance with the present invention there is provided a system for installing sprinkler heads adjacent to sidewalks, curbs, etc. where a predetermined minimum space must be obtained in order to enable an edger to safely operate in the space between a sprinkler head and the sidewalk, curb, etc. The system involves the use of a spacer or guide member which can be attached to the sprinkler body and which extends laterally outwardly an appropriate distance so that when the sprinkler head is installed the sprinkler head can be easily positioned a defined distance from a sidewalk, curb, etc. The spacer or guide prevents the sprinkler head from being placed too close to the sidewalk, curb, etc.

In one embodiment, the spacer or guide preferably includes opposing resilient fingers which are adapted to grip or fit partially around the tubular body of a sprinkler head. The spacer preferably also includes a vertically extending tab which extends upwardly (and preferably downwardly also) a predetermined distance to prevent the spacer from being positioned too high on the sprinkler body. It is preferred that the main portion of the spacer be positioned at least about 1.5 to 2 inches below the rim of the sprinkler head so that the spacer is not contacted by a conventional lawn edger which is used to cut grass along a sidewalk or curb, etc.

Thus, the spacer prevents a sprinkler from being positioned too close to solid objects such as sidewalks, curbs, etc. but the spacer does not interfere with the desired operation of the sprinkler nor does it interfere with conventional lawn edging operations. The spacer also holds the sprinkler head in place and prevents it from drifting or leaning toward a sidewalk, curb, etc. It also enables water, fertilizer, etc. to flow through it. Grass is able to grow upwardly through openings in the body of the spacer. Use of the spacer enables a sprinkler head to be safely installed close (but not too close) to a sidewalk or curb so that a spinning lawn edger does not contact it during normal edging operations. Use of the spacer creates a uniform system and standard for installing sprinklers, thus requiring less labor time and reducing sprinkler maintenance problems. The person installing the sprinkler heads saves time because use of the spacer of this invention eliminates guess work as to how close to place a sprinkler head next to a sidewalk or curb, etc. After the spacer has been placed on the sprinkler head body, the sprinkler head can be moved to the proper position (i.e. where the outer edge or surface of the spacer body 12 contacts the edge of the sidewalk or curb), soil is placed around the sprinkler head, and then the soil is tamped down. The spacer also prevents the sprinkler head from drifting toward the sidewalk or curb. The tab 18 (which preferably extends below the body portion 12 as well as above body portion 12) also provides added stability to the sprinkler head to prevent it from leaning after installation. Although some people have used rocks between the sprinkler head and a sidewalk or curb to prevent the sprinkler head from leaning, the use of rocks is time-consuming, and eventually the rocks may damage the sprinkler head by deforming it or poking a hole into it, thus requiring additional maintenance and expense.

Other advantages of the system of the invention will be apparent from the following detailed description and accompanying drawings.

BRIEF DESCRIPTION OF THE DRAWINGS

The invention is described in more detail hereinafter with reference to the accompanying drawings, wherein like reference characters refer to the same parts throughout the several views and in which:

FIG. 11 is a perspective view of yet another embodiment of spacer of the invention;

FIG. 12 is a top view of another embodiment of spacer of the invention; and

DETAILED DESCRIPTION OF THE INVENTION

Figure 1:
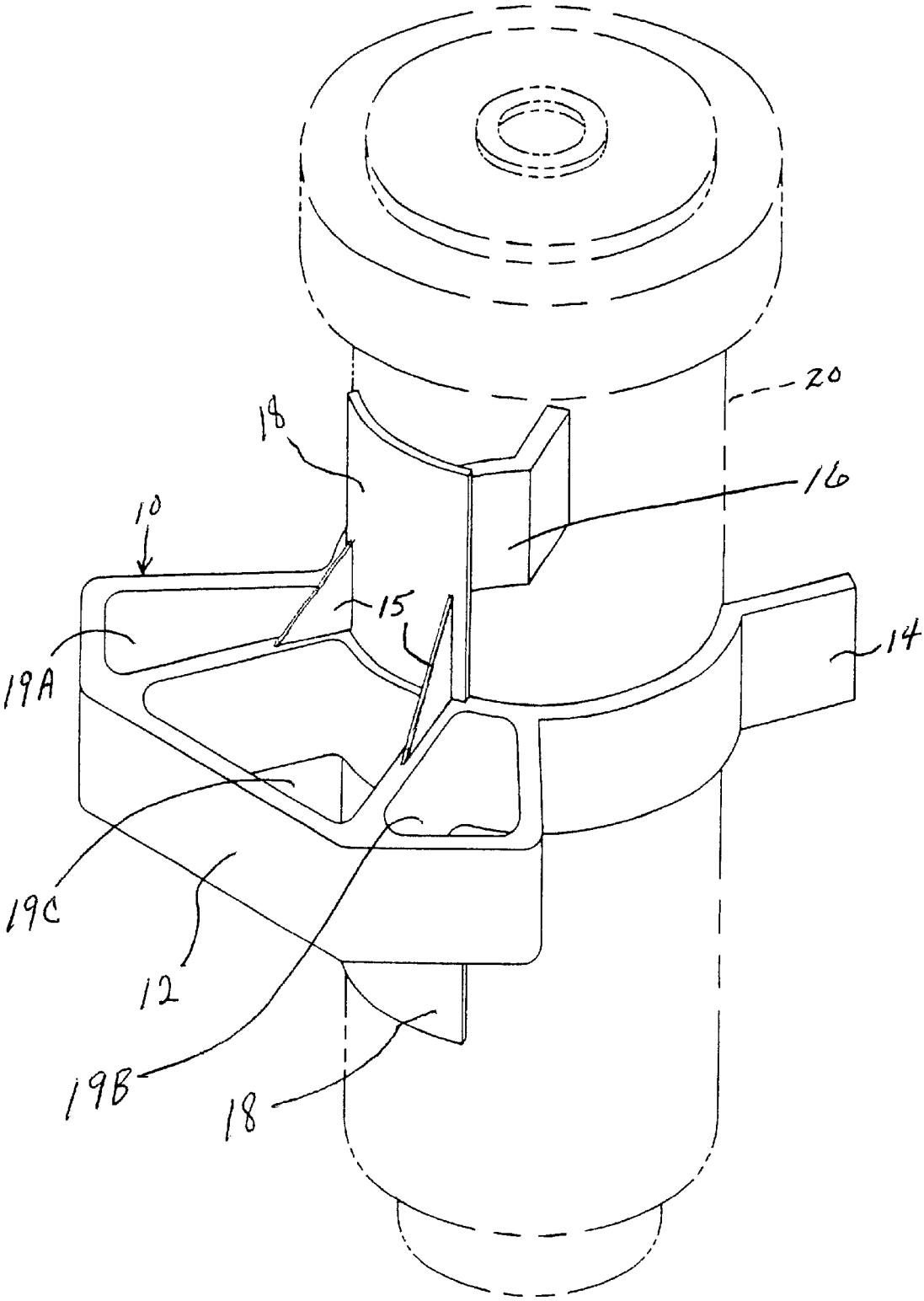
FIG. 1 is a front perspective view of one embodiment of a spacer or guide attached to a conventional sprinkler head.

The spacer and guide system of the invention is illustrated in the drawings. Thus, in FIGS. 1–4 there is shown one embodiment of a spacer or guide 10 which includes a body portion 12, opposing finger grips 14 and 16, and tab member 18 which is secured to the body portion and extends upwardly and downwardly from the body portion.

The body portion 12 includes openings 19A, 19B and 19C through it to enable grass to grow through the body portion and to allow water, fertilizer, etc. to flow downwardly through the spacer. The opposing grips 14 and 16 are resilient so that they are easily urged apart in order for them to be slipped or snapped onto the cylindrical body of a conventional sprinkler head 20. The resilient grips then hold the spacer onto the sprinkler head, although it is possible to move the spacer vertically or rotationally relative to the sprinkler head after it has been attached.

The body portion 12 can be moved upwardly relative to the sprinkler body but the vertical tab 18 prevents the body portion 12 from being attached too high on the sprinkler body (i.e. the vertical tab 18 provides a limit to upward movement or travel of the body portion 12 relative to the sprinkler head). This feature thus assures that the spacer body portion 12 will be located at a sufficient depth below the surface of the ground (e.g. about 1.5 to 2 inches) so that it will not be contacted by the spinning blade of a lawn edger during normal use. The vertical tab 18 preferably extends both upwardly and downwardly from the body portion 12 so that the spacer is symmetrical and cannot be attached improperly to a sprinkler body. Of course, the spacer body 12 can be attached even lower on the sprinkler body, if desired, so that the spacer body will be even further below the surface of the ground. Generally, the height of tab 18 may be about 1.5 to 3 inches, although other heights could also be used. If desired, additional tabs could be included on the spacer.

As shown in the drawings, the tab member 18 is positioned adjacent the curved or arcuate inner portion of the body 12 which contacts the cylindrical body of the sprinkler head. Thus, when the spacer 10 is snapped onto a sprinkler head, the tab 18 will be in contact with (or in close proximity to) the body of the sprinkler head. Then when the spacer is moved upwardly, the tab 18 will contact the underside of the rim at the top of the sprinkler and thereby prevent the spacer from being moved any further upwardly relative to the sprinkler head body. Gussets 15 may be included between the tab 18 and the spacer body to provide additional structural support to the tab.

Figure 2:
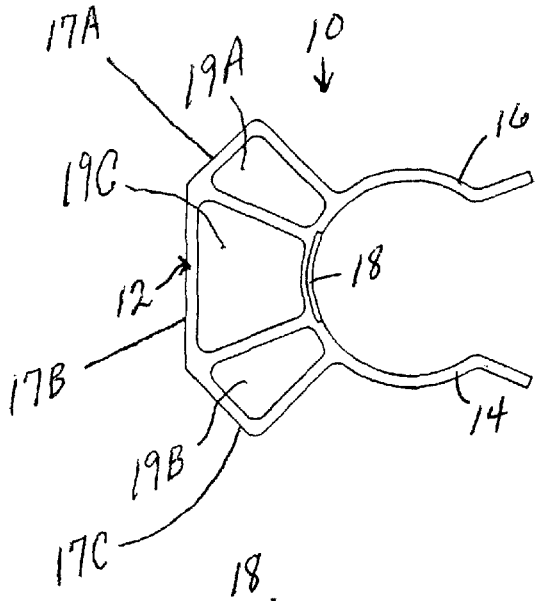
FIG. 2 is a top view of the spacer of FIG. 1.
Figure 3:
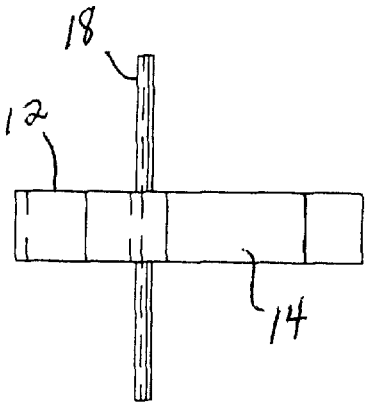
FIG. 3 is a side elevational view of the spacer of FIG. 1.
Figure 4:
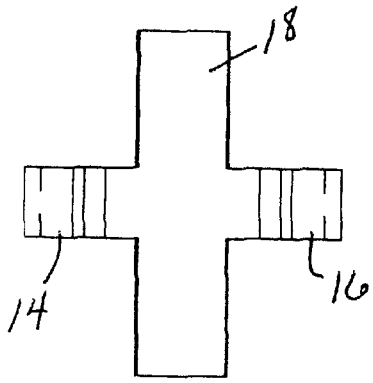
FIG. 4 is a rear elevational view of the spacer of FIG. 1.

Preferably, the spacer body 12 will include three exterior or outer vertical surfaces or edges 17A, 17B and 17C (as best shown in FIG. 2). One or more of these vertical surfaces or edges are used to determine the proper placement of a sprinkler head next to a sidewalk, curb, etc. If the sprinkler head is to be positioned adjacent to a continuous sidewalk, for example, vertical, surface 17B of the body 12 will serve as a guide in determining the proper spacing of the sprinkler head from that sidewalk. The installer simply attaches the spacer body 12 to the sprinkler head and then positions the sprinkler head such that the surface 17B of the spacer is in contact with (or in close proximity to) the vertical edge of the sidewalk. If the installer desires to install a sprinkler head in a corner where two sidewalks meet, he will position the sprinkler head such that vertical surface 17A contacts (or is in close proximity to) the vertical edge of one sidewalk and vertical surface 17C contacts (or is in close proximity to) the vertical edge of the other sidewalk.

The spacer body 12 will assure that the sprinkler head is positioned properly in that corner. In the embodiments shown in the drawings, vertical edges 17A and 17C are each at an angle of 45 degrees relative to vertical edge 17B.

Figure 5:
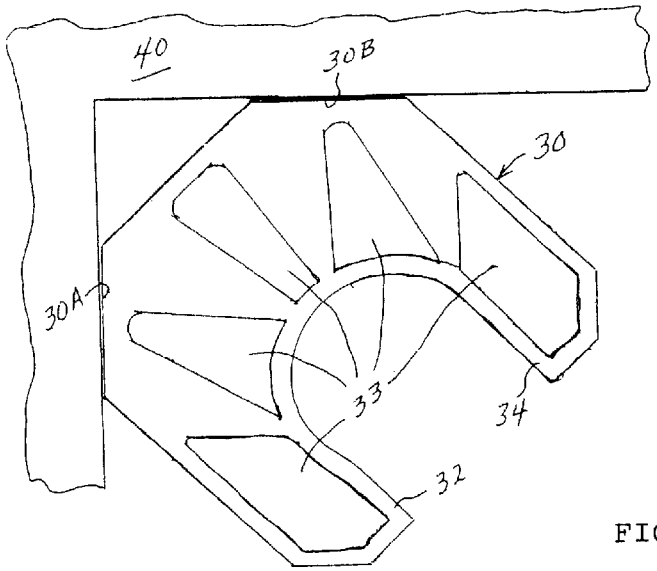
FIG. 5 is a top plan view of another embodiment of spacer useful in this invention.

Another embodiment of spacer or guide 30 is illustrated in FIG. 5, where the spacer is positioned in a right angle corner of a sidewalk 40 for positioning a sprinkler head in such corner. The spacer includes vertical edges 30A and 30B which can be placed into contact with the vertical edges of the sidewalk in the corner. The spacer 30 determines the proper location for the sprinkler head which will be gripped by opposing finger portions 32 and 34 of the spacer. Openings 33 through the spacer enable water, fertilizer, etc. to flow downwardly through the spacer. Grass can grow upwardly through such spacer. A vertical tab member can be included in this embodiment, if desired.

Figure 6:
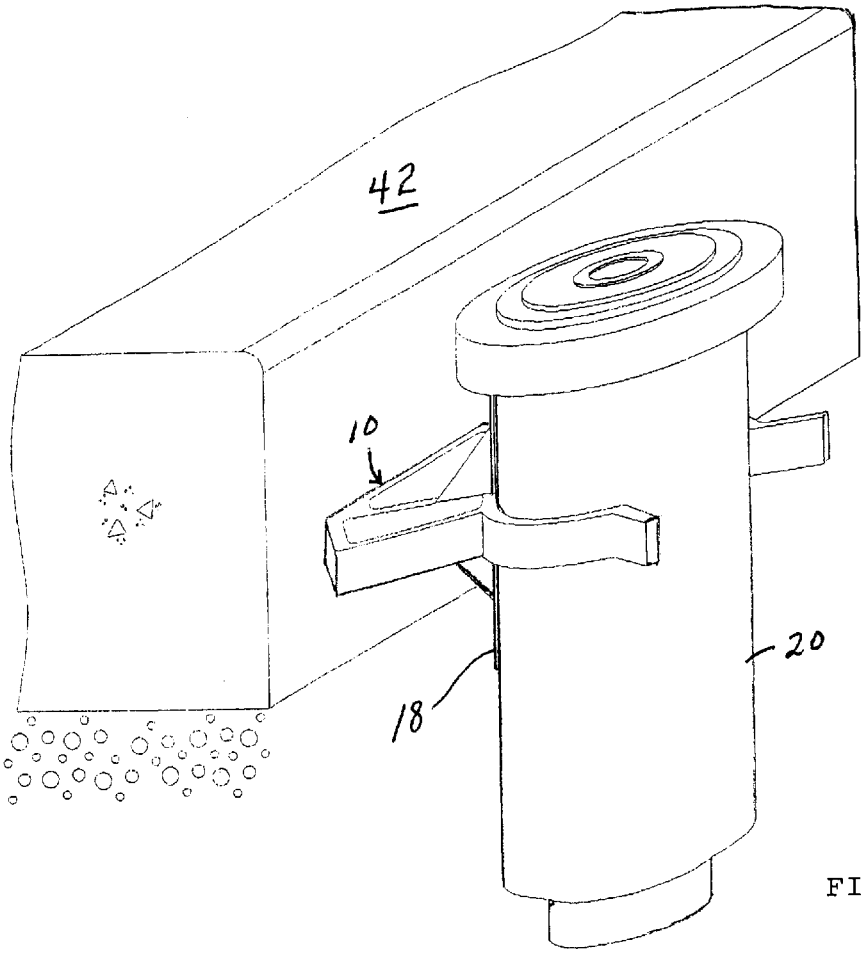
FIG. 6 is a perspective view illustrating use of the spacer of FIG. 1 on a sprinkler head positioned adjacent a solid object such as a curb.
Figure 7:
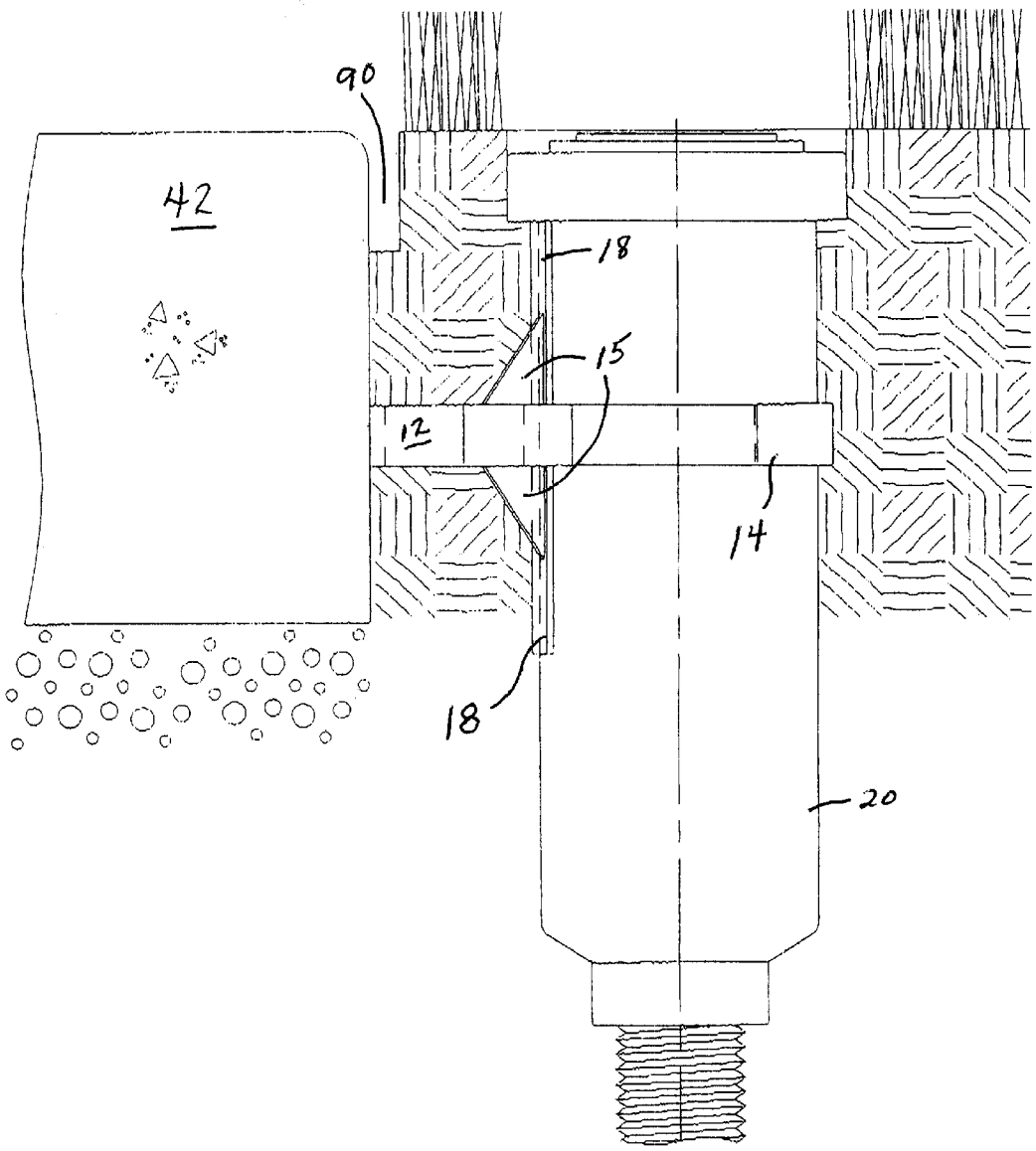
FIG. 7 is a side elevational cut-away view of the spacer system of FIG. 6 showing the location of the sprinkler head relative to the soil and grass.

FIGS. 6 and 7 illustrate the use of the spacer of FIGS. 1–4 when attached to a sprinkler head 20 and positioned adjacent a curb 42. The tab 18 prevents the spacer from being positioned too high on the sprinkler head, and the spacer body 12 assures that the sprinkler head cannot be positioned too close to the vertical edge of the curb. Then when a conventional lawn edger is used to trim grass along the curb, the lawn edger blade can be safely passed between the curb and the sprinkler head. The path 90 of the lawn edger blade is shown in FIG. 7. Thus, the spacer body is located sufficiently deep in the soil that it is not contacted by the lawn edger blade, and the spacer body prevents the sprinkler head from being positioned too closely against the curb.

Figure 8:
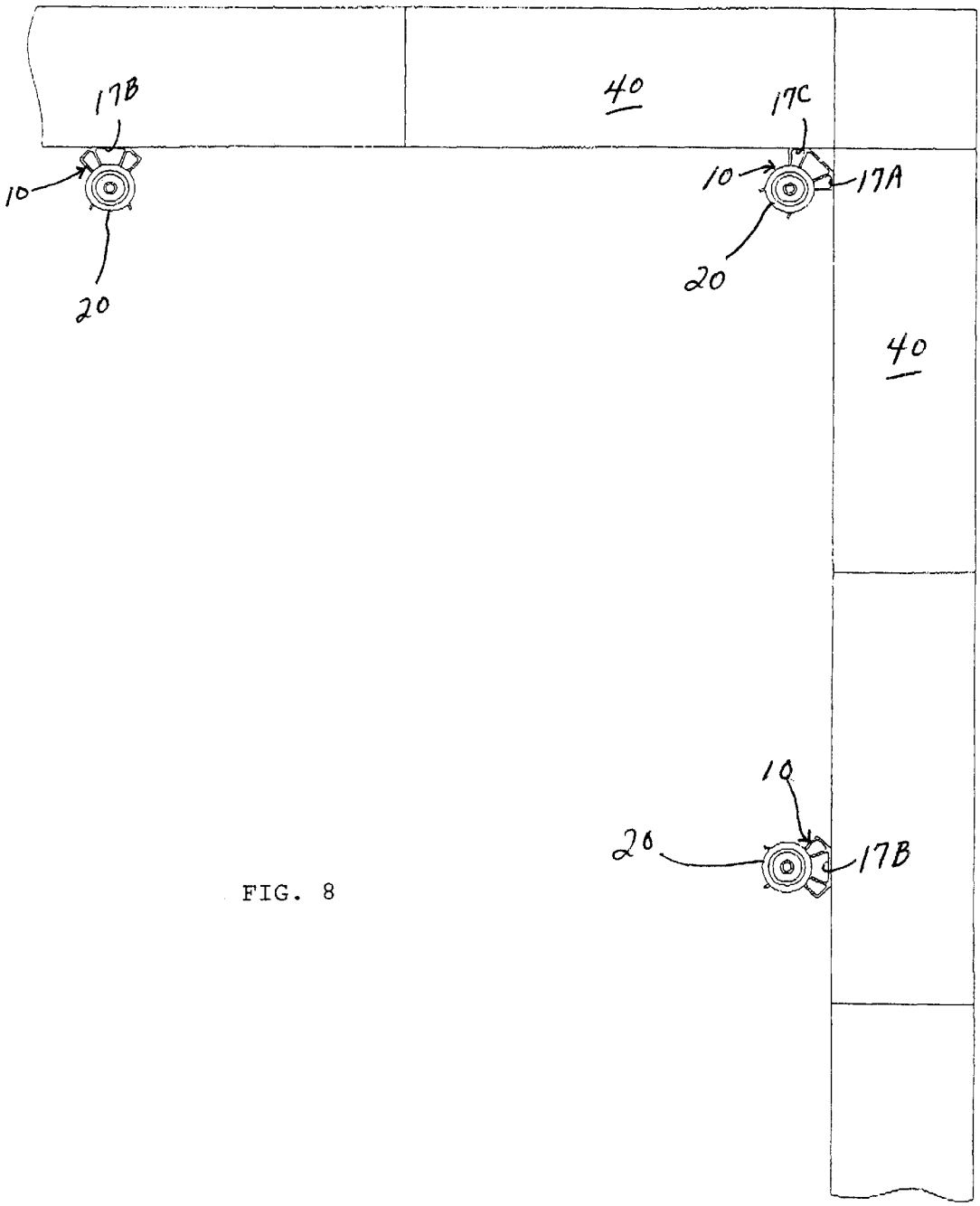
FIG. 8 is a top plan view of three sprinkler heads and three spacers of the type shown in FIG. 1 adjacent two intersecting sidewalks.

FIG. 8 is a top plan view showing use of the spacer system of FIG. 1 for positioning three sprinkler heads 20 adjacent to intersecting sidewalks 40. Two of the sprinkler heads are positioned adjacent to straight sections of the sidewalk away from the corner, and one of the sprinkler heads is positioned at the corner of the intersecting sidewalks. The same type of spacer system 10 is useful for safe positioning of each of these sprinkler heads. For sprinkler heads along the straight sections of sidewalk, vertical surface 17B of spacer system 10 determines the proper spacing of the sprinkler heads, while vertical surfaces 17A and 17C determine the correct positioning for the sprinkler head in the corner.

Figure 9:
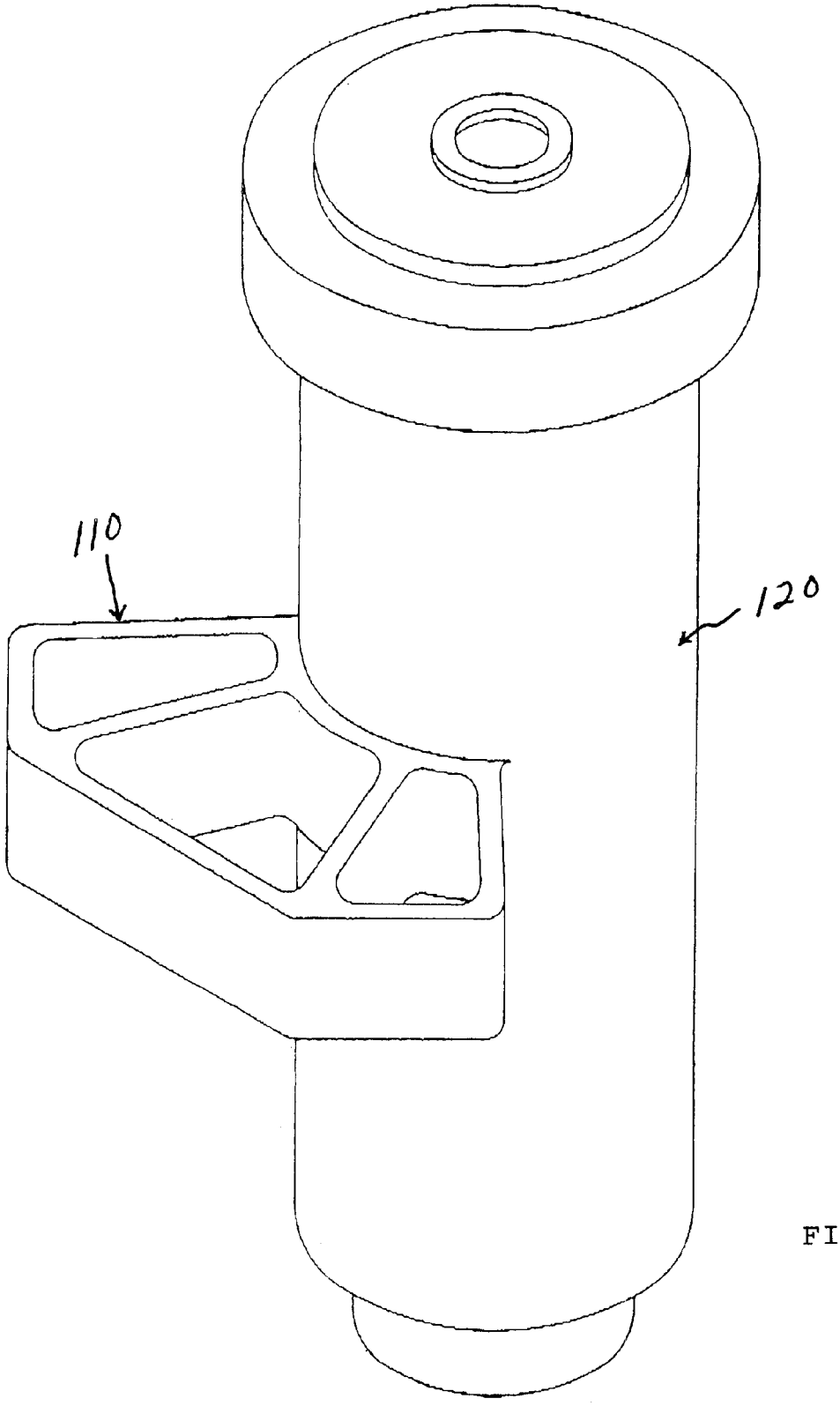
FIG. 9 is a perspective view of another embodiment of the invention in which a spacer is an integral part of a sprinkler head body.

FIG. 9 is a perspective view of another embodiment of the invention in which a spacer 110 is integrally connected to a sprinkler head 120 (e.g. the spacer could be molded as an integral part of the sprinkler head during manufacture of the sprinkler head). Another possibility is to attach spacer 110 to the sprinkler body with glue or adhesive. The spacer 110 is positioned below the top of the sprinkler head by a distance of about 1.5 to 3 inches, for example. The spacer extends outwardly a sufficient distance that the outer periphery of the top of the sprinkler head will be safely away from a sidewalk, curb, etc. when installed. Typically, the spacer preferably extends outwardly from the body of the sprinkler about 1.5 to 2 inches, for example. The spacer preferably includes openings extending through it, and it preferably includes three vertical edges on its outer periphery, as shown.

Figure 10:
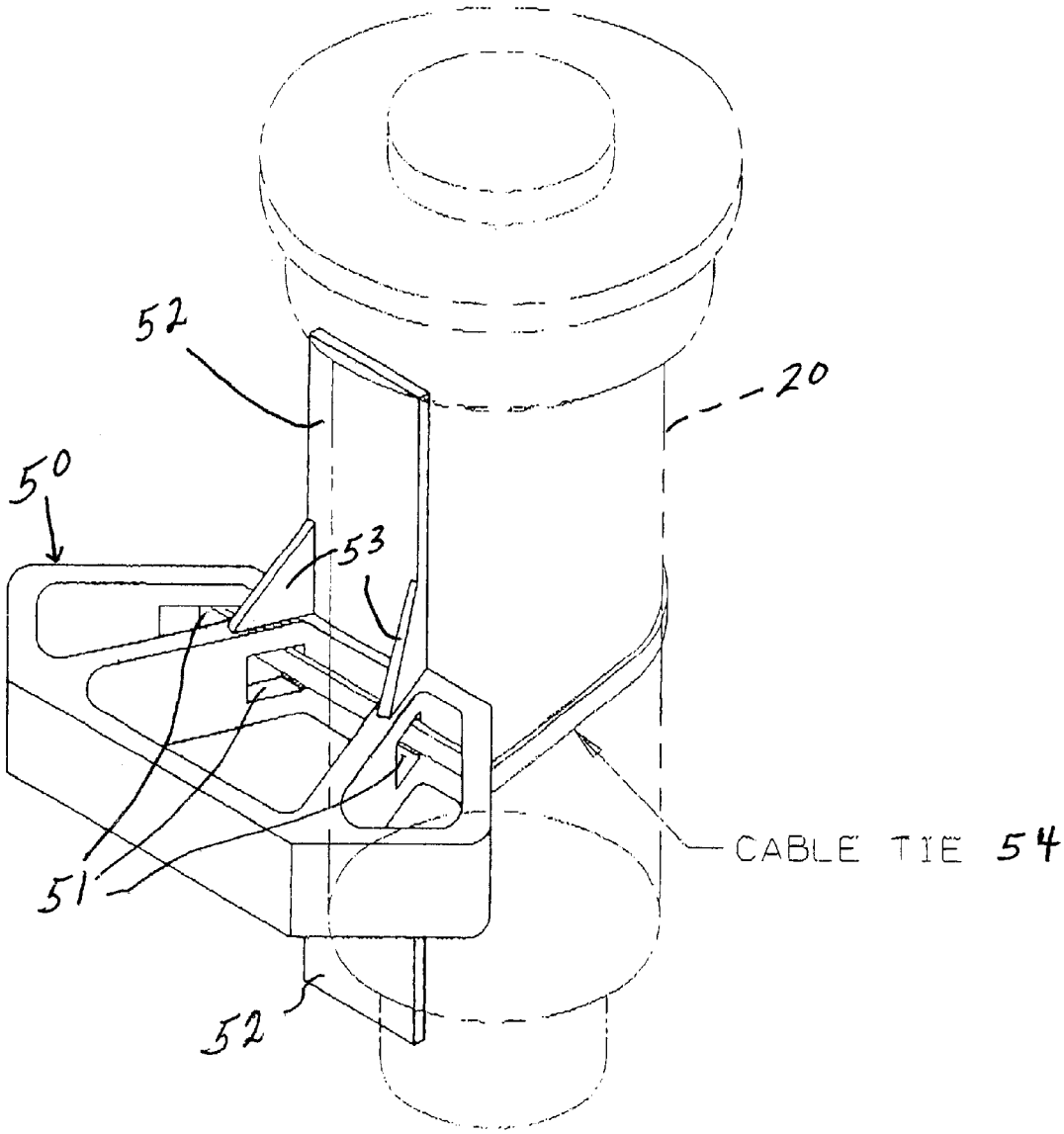
FIG. 10 is a perspective view of another embodiment of spacer of the invention.

FIG. 10 illustrates another embodiment of spacer 50 of this invention. In this embodiment the spacer body includes a vertical tab member 52 extending upwardly (and downwardly) from its inner edge, as shown. Gussets 53 between the tab and the spacer body provide additional structural support to the tab. The spacer body also includes openings 51 for receiving, for example, a cable tie 54, or a wire, string, etc. for the purpose of attaching the spacer to sprinkler head 20 of any size or shape. The spacer body includes large vertical openings to allow water, fertilizer to flow downwardly.

FIG. 11 illustrates another embodiment of spacer 60 which includes vertical tab 62 extending upwardly and downwardly from the inner edge of the spacer body. The spacer also includes hooks 61 on opposite ends. This type of spacer or guide can be attached to a sprinkler head of any size by means of rubber bands, wire, cable tie, string, etc. fastened to the hooks and extending around the sprinkler head body. The spacer body includes openings which enable water, fertilizer, etc. to flow downwardly, and they enable grass to grow through the body. Other types of fasteners could be used, of course, to attach the spacer or guide to a sprinkler head. Although not required, the presence of the vertical tab serves to prevent the spacer from being installed to high on the sprinkler head.

FIG. 12 is a top view of another embodiment of spacer 70 which is useful in this invention. This spacer includes an inner arcuate or curved edge 72 and opposing resilient fingers 74 which can be forced apart slightly to allow the spacer to be placed onto a sprinkler head and held in place by friction. The spacer body includes several flat vertical edges 73A, 73B, 73C, 73D, and 73E around its outer edge. These vertical outer edges are useful for positioning a sprinkler head close to (but spaced from) a sidewalk, curb, etc. in a landscaped area. The spacer body extends almost completely around a sprinkler head body. The spacer body also includes a plurality of openings: through it to allow water, fertilizer, etc. to flow downwardly and for grass to grow through. If desired, the spacer body could completely surround a sprinkler head.

Figure 13:
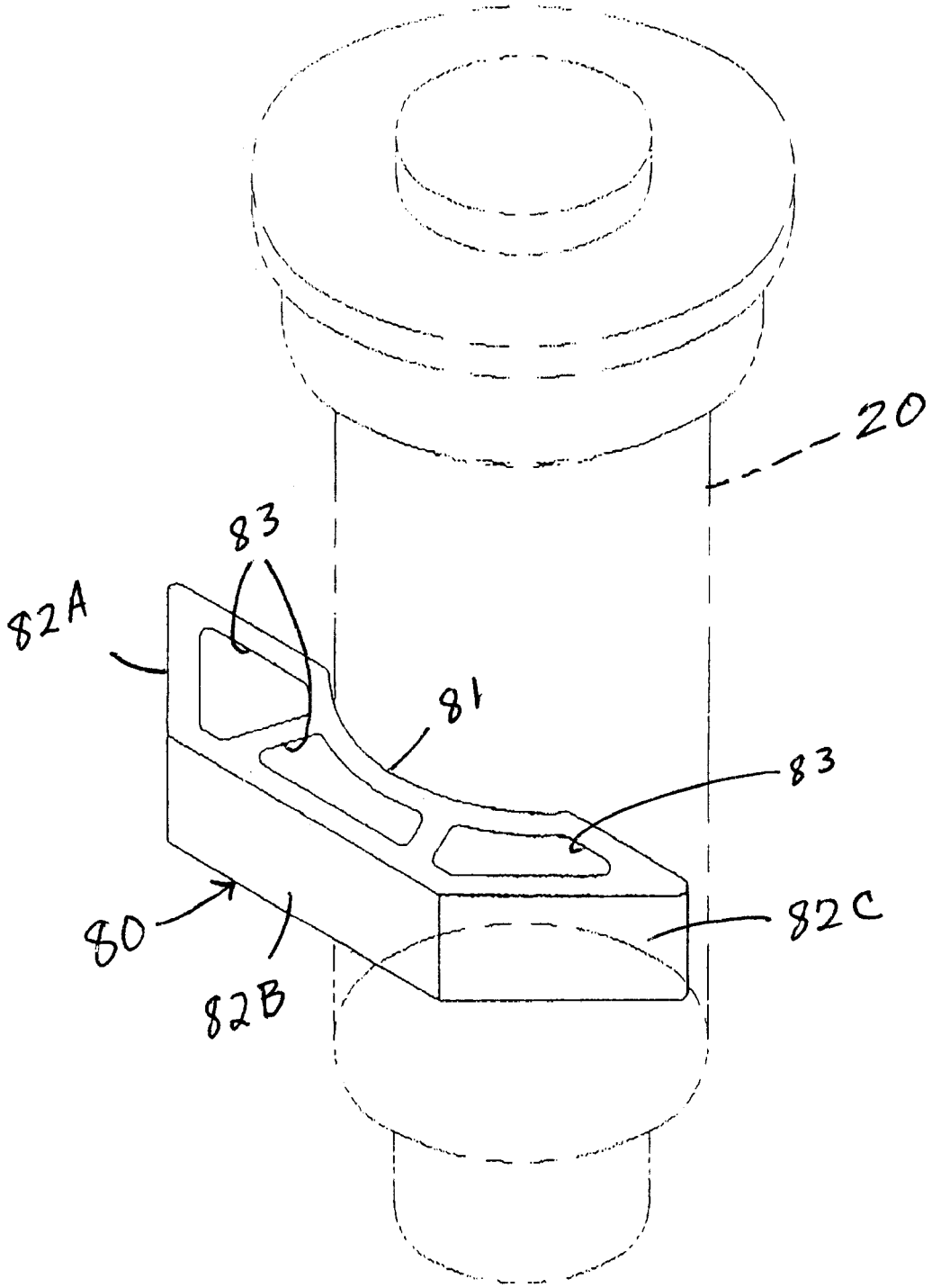
FIG. 13 is a perspective view illustrating an additional embodiment of spacer of the invention.

FIG. 13 is a perspective view of yet another embodiment of spacer or guide 80 of the invention. The spacer body includes an inner curved edge 81 and outer flat edges 82A, 82B and 82C. Edges 82A and 82C are preferably at 45 degrees relative to edge 82B. Openings 83 extend vertically through the body. This embodiment of spacer can be used, for example, in a lawn where a sprinkler head has been previously installed and is too close to a sidewalk or curb. A small opening can be made in the soil between the sprinkler head and the sidewalk, curb, etc. and the spacer 80 can be placed in that opening and then pushed downwardly to force the sprinkler head away from the sidewalk or curb. The spacer is then held in proper position by the sprinkler head, the sidewalk or curb and the soil. No additional attachment means is required for the spacer to function.

The spacer or guide of the invention can be composed of any desired material. Normally it is composed of a plastic material because of economics and because it is light in weight. Various conventional plastics are suitable (e.g. nylon, PVC, acrylic, carbonate, etc.). Metal, wood, ceramic, fiberglass or composite materials could also be used. The size and styling of the spacer could also vary and it can be made to accommodate any diameter of sprinkler head.

Other variants are possible without departing from the scope of this invention. For example, the spacer body member could have an arcuate shape (e.g. with a rounded periphery, such as a section of a disk) instead of having flat or planar sides. Preferably, the spacer body has generally planar upper and lower surfaces (i.e. an absence of upwardly extending elements on the upper surface or downwardly extending elements on the lower surface, except for reinforcing gussets, for example as shown in FIG. 1).

What is claimed is:

1. A spacer or guide system for obtaining a predetermined spacing between a sprinkler head and a sidewalk, curb, or the like, the system comprising:

(a) a spacer body having an outer peripheral portion and an inner arcuate portion joined by spaced vertical ribs which define openings through said body; and (b) attachment means for attaching said spacer body to said sprinkler head;

wherein said outer peripheral portion of said spacer body extends outwardly from said inner arcuate portion so as to enable said sprinkler head to be positioned adjacent to said sidewalk or curb with a spacing at least equal to said predetermined distance.

2. The system in accordance with claim 1, wherein said outer peripheral portion of said spacer body includes at least three vertical edges, and wherein two of said vertical edges are at an angle of about 45 degrees relative to the other of said vertical edges.

3. The system in accordance with claim 1, wherein said attachment means comprises opposing resilient finger grips for gripping said sprinkler head.

4. The system in accordance with claim 1, wherein said sprinkler head includes an outwardly extending lip, and wherein said spacer body further comprises a vertical tab member adjacent to said inner arcuate portion; wherein said vertical tab member limits the extent of upward travel of said spacer body relative to said sprinkler head when said tab member encounters said outwardly extending lip.

5. The system in accordance with claim 4, wherein said vertical tab member extends upwardly and downwardly from said spacer body member.

6. The system in accordance with claim 4, wherein said tab member has an arcuate or curved cross-section.

7. A method for determining the proper distance positioning for a sprinkler head relative to a sidewalk, curb or the like when said sprinkler head is installed, the method comprising the steps of:

(a) providing a spacer or guide comprising a body portion having a curved inner portion and an outer peripheral portion which are joined by spaced vertical ribs which define openings through said body portion, and further comprising attachment means for attaching said body portion to said sprinkler head; wherein said outer peripheral portion extends outwardly from said inner portion a predetermined distance;

(b) attaching said spacer to said sprinkler head with said attachment means;

(c) positioning said spacer and said sprinkler head adjacent to said sidewalk or curb in a manner such that said spacer provides a spacing between said sprinkler head and said sidewalk or curb which is at least equal to said predetermined distance.

8. The method in accordance with claim 7, wherein said attachment means comprises opposing resilient fingers for gripping said sprinkler head.

9. The method in accordance with claim 8, wherein said spacer further includes a vertical tab member extending upwardly adjacent to said inner portion of said body portion.

10. The method in accordance with claim 9, wherein said tab member has a curved cross-section.

11. The method in accordance with claim 9, wherein said tab member also extends vertically downwardly from said spacer body portion.

12. The method in accordance with claim 9, wherein said outer peripheral portion includes at least three vertical edges; wherein two of said edges are at an angle of 45 degrees relative to the other of said edges.

13. The method in accordance with claim 7, wherein said attachment means comprises a cable tie.

14. The method in accordance with claim 7, wherein said attachment means comprises hooks on said spacer body, and wherein said spacer body is connected to said sprinkler head by means of a flexible fastener attached to said hooks and surrounding said sprinkler head.

15. A method for preventing a sprinkler head, which has been installed in the ground adjacent a sidewalk or curb, from contacting said sidewalk or curb, the method comprising the steps of:

(a) providing a spacer comprising a body with an outer peripheral edge and an inner arcuate edge, wherein said inner and outer edges are joined by vertical ribs defining openings through said body;

(b) providing an opening in the ground between said sprinkler head and said sidewalk or curb;

(c) inserting said spacer into said opening in the ground in a manner such that said inner arcuate edge is in contact with said sprinkler head and said outer peripheral portion is in contact with said sidewalk or curb, wherein said spacer is positioned down in the ground at least about one inch; and wherein said sprinkler head is held away from said sidewalk or curb a distance of at least about one inch.

16. A spacer for obtaining a predetermined spacing between a sprinkler head and a sidewalk, curb, or the like, the spacer comprising a spacer body having an outer peripheral portion and an inner arcuate portion, wherein said peripheral portion and said inner portion are joined by spaced vertical ribs which define openings through said body; and wherein said outer peripheral portion and said inner arcuate portion are separated by at least about one inch.

17. A spacer in accordance with claim 16, wherein said peripheral portion includes at least three vertical edges; wherein two of said edges are at an angle of about 45 degrees relative to the other of said edges.

* * * * *